US011519704B1

(12) United States Patent
Dille

(10) Patent No.: US 11,519,704 B1
(45) Date of Patent: Dec. 6, 2022

(54) MONOLITHIC BULLET

(71) Applicant: Apex Outdoors LLC, Magnolia, TX (US)

(72) Inventor: Mark C. Dille, Magnolia, TX (US)

(73) Assignee: Apex Outdoors LLC, Magnolia, TX (US)

( * ) Notice: Subject to any disclaimer, the term of this patent is extended or adjusted under 35 U.S.C. 154(b) by 0 days.

(21) Appl. No.: 17/109,100

(22) Filed: Dec. 1, 2020

(51) Int. Cl.
*F42B 10/24* (2006.01)
*F42B 5/02* (2006.01)

(52) U.S. Cl.
CPC ..... *F42B 10/24* (2013.01); *F42B 5/02* (2013.01)

(58) Field of Classification Search
CPC ..... F42B 10/24; F42B 10/22; F42B 14/02; F42B 14/00; F42B 12/78
USPC ..... 102/524, 501
See application file for complete search history.

(56) References Cited

U.S. PATENT DOCUMENTS 3,345,949 A * 10/1967 Nosler ..... F42B 14/02 102/516
5,686,693 A * 11/1997 Jakobsson ..... F42B 14/02 102/515
6,070,532 A 6/2000 Halverson
8,573,129 B1 11/2013 Smitchko
9,316,468 B2 * 4/2016 Rall ..... F42B 33/001
9,534,876 B2 * 1/2017 Silvers ..... F42B 33/00
9,709,368 B2 * 7/2017 Mahnke ..... F42B 10/22
9,857,155 B2 * 1/2018 Boatright ..... F42B 14/02
10,222,188 B2 * 3/2019 Kunz ..... F42B 14/02
10,352,669 B2 7/2019 Fournier et al.
10,386,164 B2 * 8/2019 Polovnev ..... F42B 14/02
10,480,917 B2 11/2019 Kunz et al.
10,480,918 B2 * 11/2019 Kunz ..... F42B 14/02
10,502,536 B2 * 12/2019 Mahnke ..... F42B 10/46
10,578,410 B2 * 3/2020 Mahnke ..... F42B 5/025
10,578,412 B2 * 3/2020 Kunz ..... F42B 10/44
11,041,703 B2 * 6/2021 Mahnke ..... F42B 12/02
(Continued)

FOREIGN PATENT DOCUMENTS

AU 2015288295 A1 * 12/2016 ..... F42B 10/22
CA 2861961 A1 * 6/2013 ..... F42B 12/34
(Continued)

OTHER PUBLICATIONS

Sporting Arms & Manufacturers' Institute, Inc., *National Standards: Voluntary Industry Performance Standards for Pressure and Velocity of Centerfire Rifle Ammunition for the Use of Commercial Manufacturers* (SAAMI Z299.4-2015) (Dec. 2015).
(Continued)

*Primary Examiner* — Jonathan C Weber
(74) *Attorney, Agent, or Firm* — Keith B. Willhelm

(57) ABSTRACT

A monolithic bullet has a tapered nose and a cylindrical shank. The shank has a sealing boss, a groove, a case alignment boss, and a bore riding surface. The case alignment boss is adjacent the nose and has a diameter greater than the nominal groove diameter of a rifle barrel of the same caliber as the bullet. The groove is adjacent the sealing boss and has a diameter less than the nominal groove diameter of the barrel. The case alignment boss is adjacent the groove and has a diameter approximately equal to or less than the nominal groove diameter of the barrel. The bore riding surface has a diameter approximately equal to the nominal bore diameter of the barrel.

52 Claims, 7 Drawing Sheets

(56) References Cited

U.S. PATENT DOCUMENTS

| | | | | |
|---|---|---|---|---|
| 11,118,883 | B2 * | 9/2021 | Kunz | F42B 10/44 |
| 11,181,351 | B2 * | 11/2021 | Mahnke | F42B 12/02 |
| 11,181,352 | B1 * | 11/2021 | Smitchko | F42B 14/02 |
| 2014/0318406 | A1 * | 10/2014 | Rall | F42B 12/34 102/510 |
| 2015/0226531 | A1 * | 8/2015 | Silvers | F42B 33/001 249/117 |
| 2016/0153757 | A1 * | 6/2016 | Mahnke | F42B 10/22 102/501 |
| 2016/0327380 | A1 * | 11/2016 | Kunz | F42B 10/44 |
| 2017/0089677 | A1 * | 3/2017 | Boatright | F42B 30/02 |
| 2017/0314900 | A1 * | 11/2017 | Mahnke | F42B 12/74 |
| 2017/0322002 | A1 * | 11/2017 | Mahnke | F42B 12/02 |
| 2018/0094911 | A1 * | 4/2018 | Fournier | F42B 12/34 |
| 2018/0306562 | A1 * | 10/2018 | Polovnev | F42B 10/46 |
| 2019/0113318 | A1 * | 4/2019 | Taylor | F42B 14/02 |
| 2019/0137247 | A1 * | 5/2019 | Kunz | F42B 10/44 |
| 2019/0212114 | A1 * | 7/2019 | Kunz | F42B 14/02 |
| 2019/0212115 | A1 * | 7/2019 | Kunz | F42B 14/02 |
| 2020/0116462 | A1 * | 4/2020 | Mahnke | F42B 30/02 |
| 2020/0217632 | A1 * | 7/2020 | Mahnke | F42B 12/06 |
| 2020/0393226 | A1 * | 12/2020 | Kunz | F42B 14/02 |
| 2021/0310775 | A1 * | 10/2021 | Mahnke | F42B 10/24 |

FOREIGN PATENT DOCUMENTS

| | | | | |
|---|---|---|---|---|
| EP | 3187817 | A2 * | 7/2017 | F42B 10/44 |
| EP | 3855109 | A1 * | 7/2021 | F42B 12/34 |

OTHER PUBLICATIONS

*Ballistic's Complete Guide to Bullet Designs and Choosing the Best* Ballistic Magazine (Precision ed. 2019) (https://www.ballisticmag.com/complete-guide-bullet-designs/).

*Ballistics, Ogives, and Bullet Shapes* (*Part 1*), Math Encounters Blog (Jan. 11, 2011) (https://www.mathscinotes.com/2011/01/ballistics-ogives-and-bullet-shapes-part-1/).

*Monolithic Bullets and Why You Should Try Them for Hunting*, Tactical Life (Sep. 20, 2018) (https://www.tactical-life.com/gear/ammo/monolithic-bullets-hunting/).

*New CuRx™ Laathe-Turned, Solid Copper 22LR Bullets*, Cutting Edge Bullets, LLC (www.cuttingedgebullets.com).

Sporting Arms & Manufacturers' Institute, Inc., *National Standards: Voluntary Industry Performance Standards for Pressure and Velocity of Rimfire Sporting Ammunition for the Use of Commercial Manufacturers* (SAAMI Z299.4-2015) (Dec. 2015).

* cited by examiner

MONOLITHIC BULLET

FIELD OF THE INVENTION

The present invention relates to bullets and cartridges for rifles, more particularly, to monolithic bullets and cartridges having monolithic bullets.

BACKGROUND OF THE INVENTION

A rifle is a long-barreled firearm that has a rifled barrel. That is, the barrel has helical grooves cut into the bore of the barrel. A bullet is fired by first igniting a primer. The primer in turn ignites powder, which combusts rapidly and generates a pulse of high-pressure gas that propels the bullet forward. As the bullet travels through the bore, the grooves cause the bullet to spin. The spin stabilizes the bullet in flight and greatly increases the accuracy and range of its trajectory.

The first rifles were a refinement on smooth bored muskets. One of the earliest rifled muskets was the Springfield Model 1855 adopted by the U.S. Army shortly before the Civil War. It fired "Minié balls," so named after Claude-Étienne Minié, inventor of the Minié rifle. Despite their name, Minié balls had an elongated, generally cylindrical shape with a tapered, conical nose. That gave them much better aerodynamic properties than the balls fired by the earliest firearms. The rifled barrel and conical bullet greatly improved the rifle's accuracy and range over smooth bore muskets. Rifled muskets provided the Union Army with significant tactical advantages, especially before they became widely available to Confederate troops.

Early rifled muskets, like their smooth-bore predecessors, were muzzle loaders. The bullet and powder were pushed down into the firing chamber from the forward open end, or "muzzle" of the barrel. Primer was provided at the rear end, or breach of the barrel. Modern rifles, however, fire cartridges and are breach loading. The cartridge provides self-contained ammunition incorporating primer, powder, and a bullet. The rifle has a mechanism, or "action" that loads, locks, fires, extracts, ejects, and otherwise handles the cartridge as the rifle is fired.

Rifle cartridges today typically have a generally cylindrical metal case. The case usually is made of brass and has a closed, rear end or "case head." Most of the cartridge case is packed with powder. The bullet is seated in the open, forward end of the case. The cartridge also has a percussion cap mounted in the case head. The percussion cap is filled with shock sensitive primer. When struck by the firing pin of the action, the primer ignites, causing the powder to burn. The burning powder releases a pulse of high-pressure gas that propels the bullet out of the cartridge and down the barrel.

Early cartridges used black powder. Cordite—a smokeless powder—was introduced around 1886. Cordite generates much less smoke upon combustion than black powder. It also generates more progressive and ultimately higher pressures as it combusts. Even more favorable pressure curves are generated by powders used in modern cartridges, such as nitrocellulose or a mixture of nitrocellulose and nitroglycerin. Those developments in powder, along with improvements in cartridge and barrel technology, meant that bullets could be fired with ever increasing power and velocity.

Those efforts in turn spurred developments in bullet technology. The earliest cartridge bullets were made from cast lead. Lead is a soft, ductile metal. That ductility allows lead bullets to shorten and expand radially, or "slug," under pressure generated by firing the cartridge. Slugging allows contact between the bullet and the bore grooves. The grooves shape or "engrave" the slugged bullet and impart spin to it as it travels through the bore.

The practical speed limit for lead bullets, however, is around 2,200 feet per second. Beyond that, lead bullets slug excessively, deposit increased amounts of lead in the bore, and encounter various adverse aerodynamic effects in flight. Thus, most bullets today have a lead core with an outer layer of copper or another gilding metal. They are made by a swaging process that allows the bullet to be formed more precisely. The outer jacket also reduces the amount of slugging. The cartridge can be charged with more powder and can generate more firepower than cartridges with lead bullets.

Jacketed bullets, however, have not kept pace with other advances in firearm technology, at least insofar as the highest power rifles are concerned. Through two world wars and in the succeeding years, continuing advances led to rifles that were capable of firing bullets at progressively higher velocities. As impact velocities exceeded around 3,000 feet per second, jacketed bullets began to show erratic performance. Most significantly, there was a growing tendency for the jacket of high power, high velocity bullets to separate from the lead core. Lead also is highly toxic, and jacketed bullets are composed primarily of lead. They can leave fragments in game that are ingested by wildlife and humans.

Various efforts were made to address the problem of separation in jacketed bullets. The gilded jacket was made thicker, the lead core was bonded to the jacket, and other approaches were tried, all of which had varying degrees of success. In 1986, however, the X bullet was introduced by Barnes Bullets, LLC, Mona, Utah. The X bullet was the first monolithic or "mono" bullet to achieve success in the marketplace. Unlike jacketed bullets, but like early lead cartridge bullets, monolithic bullets are fabricated from a single piece of solid metal. They are not fabricated, however, from lead. They are made from copper or a copper alloy.

Monolithic bullets solved the increasingly frequent problem of separation in jacketed bullets and allow for more powerful cartridges capable of propelling the bullet at higher velocities. They also are lead-free and do not pose the environmental and public health risks associated with jacketed bullets. Those advantages have meant that jacketed bullets increasingly are being abandoned in favor of monolithic bullets, especially in cartridges used for hunting.

Monolithic bullets, however, face challenges of their own. Chief among them is consistency from shot to shot and from rifle to rifle. At a superficial level, consistency should be built into modern firearms, and indeed, they have benefited greatly from standardization. The nominal diameter or "caliber" of a bullet is closely matched to the size or "caliber" of a rifle's bore. In the United States, rifle calibers reference the bore diameter, that is, the diameter measured from the top or "lands" of the groove in inches. Elsewhere, rifle calibers reference groove diameters, the diameter measured from the bottom of the grooves in millimeters. Regardless, specifications for each designated caliber have been established by the Sporting Arms and Ammunition Manufacturers' Institute, Inc. (SAAMI). Those standards provide safety, reliability, and interchangeability standards for commercial manufactures of firearms, ammunition, and components. They have been adopted widely, and today the vast majority of commercially available ammunition and firearms meet the SAAMI specifications. Thus, bullets of a given caliber generally can be fired safely from any rifle of the same caliber, and vice versa.

The SAAMI specifications, however, allow variation among the actual dimensions of firearms and cartridges. The specifications are stated as a range of values from a nominal value. Thus, one barrel of a given caliber may be "tight," that is, provide a relatively small difference between its groove diameter and the diameter of the bullet. Another barrel of the same caliber may be "loose," having a relatively large difference in groove and bullet diameters. The diameter of a given bullet, for example, may be at the high end of SAAMI specifications, while the barrel dimensions may be at the low end, or vice versa. Such differences mean that, apart from variation inherent in the manufacturing process, the dynamics between bullet and bore and, therefore, the speed and range of a bullet's trajectory will be different from rifle to rifle.

Variations in bullet-bore dynamics due to the "tightness" or "looseness" are less significant in lead and jacketed bullets. Being composed entirely or primarily of lead, they are quite ductile. A given difference in the "tightness" or "looseness" of a bore will not increase or decrease the energy lost as a lead bullet is deformed and travels through the barrel nearly to the same degree as in monolithic bullets. Copper is relatively hard and far less ductile than lead. That relative lack of ductility means that monolithic bullets are much more affected by variations in barrel dimensions and, consequently, that the speed and range of their trajectories is much less consistent from rifle to rifle.

Differences in material properties create other issues with monolithic bullets. Copper being harder than lead, monolithic bullets also have a greater tendency to gall a bore as they travel through a barrel. Most significantly, because they are less ductile, monolithic bullets do not slug as much as lead or jacketed bullets. Thus, if fired through a relatively loose barrel, a monolithic bullet may not slug enough to establish a seal with the barrel. Hot, pressurized gas from the combusting powder can blow by the bullet. Over time, those hot jets of gas can crack and erode the throat of the barrel, that is, the first 3 to 4 inches of the barrel ahead of the firing chamber. On the other hand, if the barrel is relatively tight, the bullet may be significantly larger than the groove diameter of the barrel. An excessively hard, tight seal can be formed. Tight seals can lead to higher chamber pressures and increased friction between the bullet and bore.

Both scenarios can increase galling or other fouling of the bore and decrease the velocity and range of a monolithic bullet. In looser barrels, hot gas flows around the bullet heating it more rapidly and imparting less forward momentum. In tighter barrels, more friction is created between the bullet and barrel. The firepower generated by the cartridge produces more recoil and less forward momentum in the bullet. Those effects in turn diminish the accuracy of the rifle and produce differences in the bullet's trajectory from rifle to rifle.

Attempts have been made to minimize such deficiencies. Monolithic bullets typically have slight annular grooves in the generally cylindrical surface of the bullet's mid-section or "shank." "Grooved" monolithic bullets include the TSX, TTSX, and LRX bullets sold by Barnes Bullets. The grooves provide space into which can flow the material displaced as the bullet is engraved by the bore grooves. By providing space for displaced material, the maximum diameter of a bullet of a given caliber can be increased. That has generally helped to minimize problems with "loose" barrels, while at the same time avoiding high chamber pressures associated with "tight" barrels. The grooves also reduce the total bearing surface of the bullet in frictional contact with the bore. In large part those bullets have acceptable velocity and accuracy.

While the grooves greatly improve the dynamics between the bullet and the bore, they negatively affect the aerodynamic profile of the bullet. Secondary shock waves are created by the grooves when the bullet is traveling at supersonic speeds. Those shock waves significantly increase drag on the bullet. As the bullet approaches subsonic velocities, the transonic zone, the grooves create boundary layer separation in the air passing over the bullet that can destabilize the bullet and cause it to deviate from its supersonic trajectory. Those effects reduce the range and accuracy of the bullet's trajectory. Thus, as disclosed in U.S. Pat. No. 10,352,669 to G. Fournier et al., transition zones into and out of the grooves have been used to reduce the amount of drag on the bullet.

Despite such improvements, monolithic bullets continue to exhibit shortcomings. Higher velocity often is achieved at the expense of higher chamber pressures. Better sealing between the bullet often creates more friction as the bullet travels through the bore. Accuracy from shot to shot, and especially from rifle to rifle is frequently less than satisfactory.

The statements in this section are intended to provide background information related to the invention disclosed and claimed herein. Such information may or may not constitute prior art. It will be appreciated from the foregoing, however, that there remains a need for new and improved monolithic bullets and monolithic bullet cartridges. Such disadvantages and others inherent in the prior art are addressed by various aspects and embodiments of the subject invention.

SUMMARY OF THE INVENTION

The subject invention, in its various aspects and embodiments, relates generally to monolithic rifle bullets having improved profiles in the bullet shank. The invention encompasses various embodiments and aspects, some of which are specifically described and illustrated herein. One broad aspect and embodiment of the invention provides monolithic bullets that are adapted for use in a cartridge for a firearm with a rifled barrel. The bullet has a designated caliber and a nominal diameter associated with the bullet caliber. The barrel of the rifle has a designated caliber the same as the bullet caliber and has a nominal bore diameter and a nominal groove diameter associated with the barrel caliber. The bullet comprises a tapered nose and a generally cylindrical shank. The shank comprises a sealing boss, a groove, a case alignment boss, and a bore riding surface. The sealing boss is adjacent the tapered nose and has a diameter greater than the nominal groove diameter of the rifled barrel. The groove is adjacent the sealing boss and has a diameter less than the nominal groove diameter of the rifled barrel. The case alignment boss is adjacent the groove and has a diameter approximately equal to or less than the nominal groove diameter of the rifled barrel. The bore riding surface has a diameter approximately equal to the nominal bore diameter of the rifled barrel. The bullet shank is formed from one piece of solid metal.

Other embodiments of the subject invention provide such bullets where the sealing boss has a diameter from about 0.0001 to about 0.0015 inches larger than the nominal groove diameter of the rifled barrel.

Yet other embodiments provide such bullets where the sealing boss has an axial length of from about 0.001" to 0.008 inches.

Still other embodiments provide such bullets where the groove has a diameter from about 0.001 to about 0.004 inches smaller than the nominal groove diameter of the rifled barrel.

Additional embodiments provide such bullets where the groove has an axial length of from about 0.025 to about 0.050 inches.

Further embodiments provide such bullets where the case alignment boss has a diameter from about equal to about 0.001 inches less than the nominal groove diameter of the rifled barrel.

Other embodiments provide such bullets where the case alignment boss has an axial length of from about 0.01 to about 0.03 inches.

Yet other embodiments provide such bullets where the bullet shank comprises a first the case alignment boss adjacent the forward limit of the bore riding surface and a second the case alignment boss adjacent the rearward limit of the bore riding surface.

Still other embodiments provide such bullets where the bore riding surface has a diameter equal to the nominal bore diameter of the rifled barrel plus-minus 0.0005 inches.

Additional embodiments provide such bullets where the taper of the nose is an ogive having a parabolic, Haack, or von Karman curve.

Further embodiments provide such bullets where the nose ogive intersects with the sealing boss at a secant.

Other embodiments provide such bullets where the nose is a hollow nose having a tip, a hollow nose, or a solid nose.

Yet other embodiments provide such bullets where the bullet comprises a tail portion.

Still other embodiments provide such bullets where the tail portion is tapered.

Addition embodiments provide such bullets where the taper of the tail is an ogive having a parabolic curve or a von Karman or other Haack curve.

Further embodiments provide such bullets where the tail ogive intersects with a second the case alignment boss adjacent the rearward limit of the bore riding surface.

Other embodiments provide such bullets where the bullet groove comprises one or both of a tapered transition area leading out of the sealing boss or into the case alignment boss.

Yet other embodiments provide such bullets where the bullet bore riding surface comprises one or both of a tapered transition area leading from a first case alignment boss or into a second case alignment boss.

Still other embodiments provide such bullets where one or more of the tapered transition areas extend at an angle of from about 1° to about 15°.

Additional embodiments provide such bullets where the taper of the transition area is an ogive having a parabolic curve or a von Karman or other Haack curve.

Further embodiments provide such bullets where the transition area ogive intersects with a raised profile element of the shank at a secant.

Other embodiments provide such bullets having various combinations of the foregoing as will be apparent to workers in the art.

In other aspects and embodiments, the subject invention provides cartridges for a firearm with a rifled barrel. The cartridges comprise a case, powder, and a novel bullet.

Other embodiments provide such cartridges where the bullet is mounted in a neck of the cartridge and the periphery of the neck is crimped into the groove.

Yet other embodiments provide such cartridges where the cartridge comprises a percussion cap in which is carried a primer.

Additional embodiments provide cartridges having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the way it may be practiced. The subject invention encompasses other embodiments consistent with the claims set forth herein.

Figure 1A:
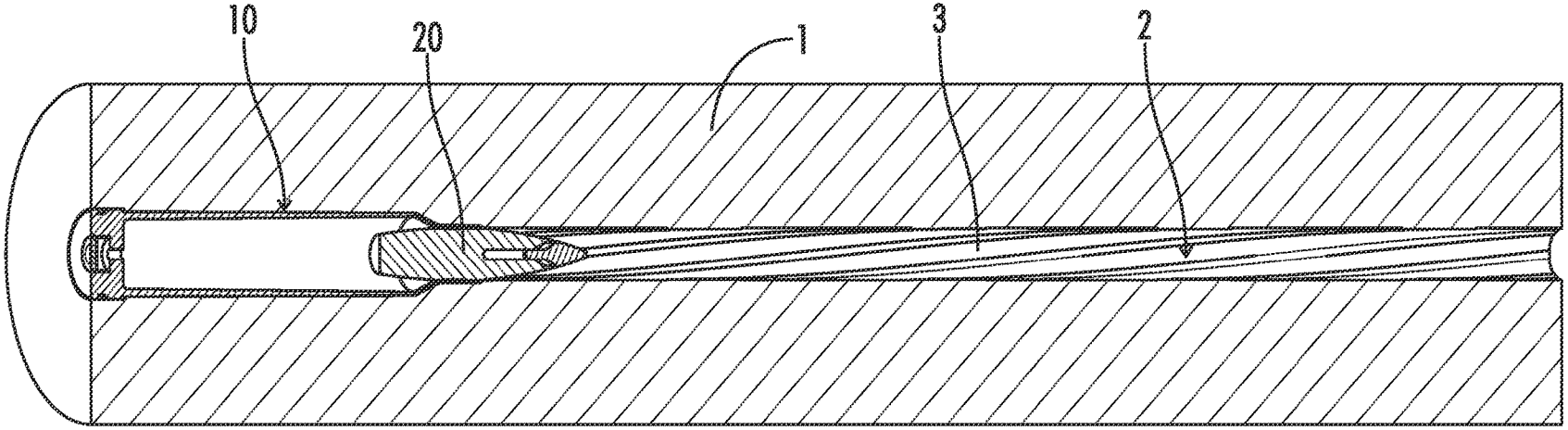
FIG. 1A is an isometric, cross-sectional view of a first preferred embodiment 10 of the cartridges of the subject invention, which cartridge 10 has a first preferred embodiment 20 of the novel bullets of the subject invention and is shown in the firing chamber of a barrel 1 of a firearm.

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The invention, in various aspects and embodiments, is directed generally to monolithic rifle bullets and rifle cartridges having monolithic bullets. Some of those embodiments are described is some detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

Overview of Novel Ammunition

Broad embodiments of the subject invention include novel rifle cartridges that comprise a case, powder, and a novel monolithic bullet. For example, a first preferred embodiment 10 of the novel cartridges is shown in FIGS. 1-4. Cartridge 10 generally comprises a case 11, powder 12, a percussion cap 13, and a first preferred embodiment 20 of the novel bullets.

Figure 1B:
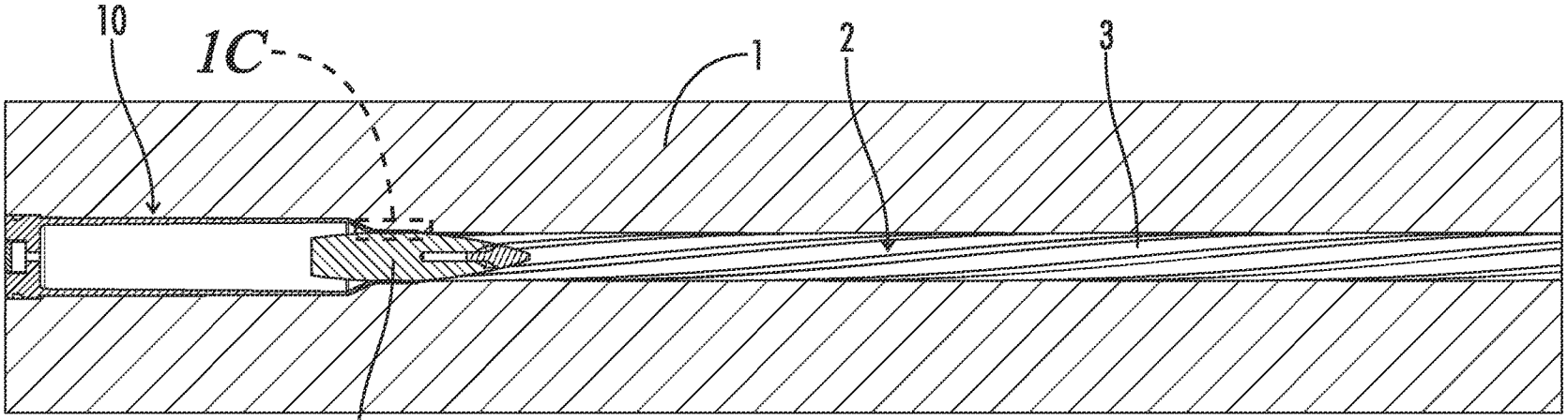
FIG. 1B is a cross-sectional view of novel cartridge 10 shown in FIG. 1A.
Figure 1C:
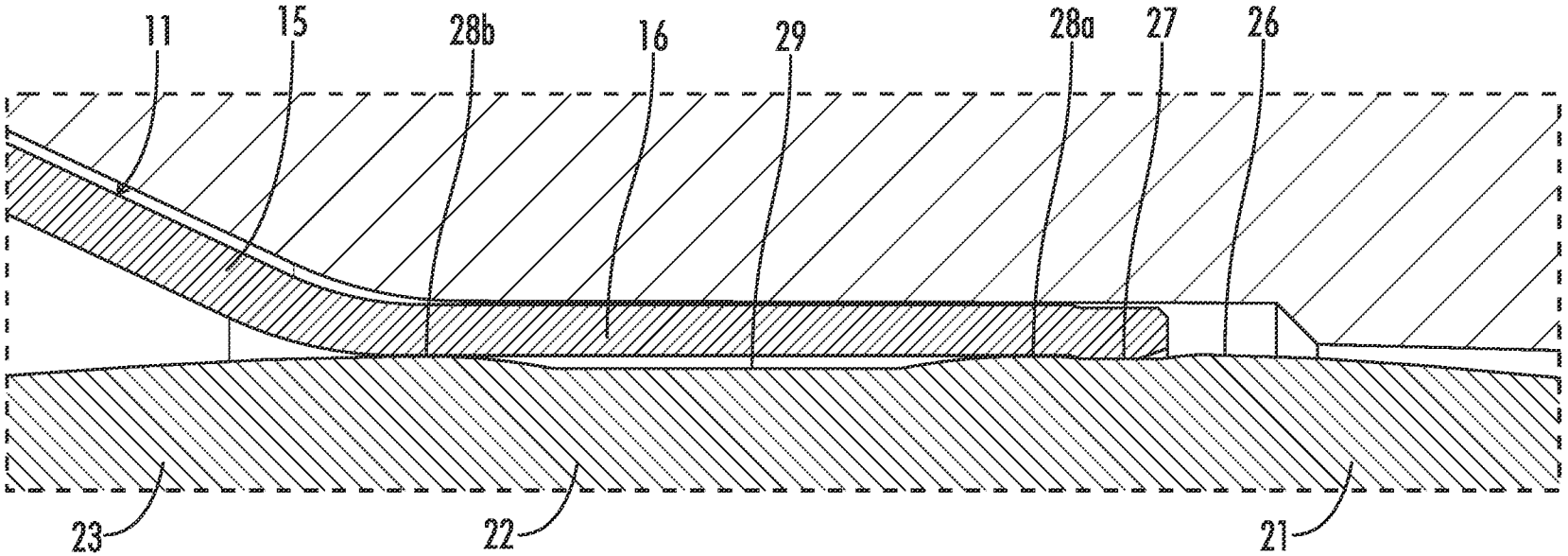
FIG. 1C is an enlarged, cross-sectional view taken from area 1C of FIG. 1B showing profiles in bullet 20.

FIG. 1 show cartridge 10 in the firing chamber of a barrel 1 of a rifle. Cartridge 10 is a 300 Winchester Magnum cartridge. It has a 30-caliber bullet suitable for firing from a 30-caliber rifle. Barrel 1, therefore, is of the same caliber, for example, the barrel of a Remington 700 30-caliber rifle. Modern rifles typically are classified by the number of shots fired when the gun's trigger is pulled. Single shot rifles, such as bolt action, lever action, pump action, and semi-automatic rifles fire a single shot for each pull of the trigger. Automatic rifles can fire multiple shots during a single trigger squeeze. Those differences generally arise from the different actions of the rifle that load, lock, fire, extract, eject, and otherwise handles cartridges as the rifle is fired.

The Remington 700 has a single-shot, bolt action and a magazine capable of holding 2 to 5 cartridges. Novel cartridges, however, may be provided for all calibers of rifles having many different types of action. Thus, for the sake of simplicity, other features of the rifle are not shown in the figures. Nevertheless, it will be appreciated by those skilled in the art that the rifle's action includes a bolt that is manipulated by an external handle. The bolt actuates an extractor to remove a spent cartridge and a lifter to load a fresh cartridge into the chamber. A trigger will release a firing pin to fire the cartridge.

Case 11 is made of metal. As seen best in FIG. 2, case 11 is a profiled cylinder, with its major portion being cylindrical. The rear end, or head of case 11 is closed while the forward end is open. An annular rim and groove 14 extend around the circumference of the rear end of case 11. Rim and groove 14 allow the extractor of the rifle's action to grab cartridge 10 and remove it from the firing chamber once it has been fired. The forward end of case 11 tapers radially inward along a shoulder 15 to a relatively narrow, open neck 16. The majority of case 11 is filled with powder 12. Percussion cap 13 is mounted in a short, cylindrical recess in the base of case 11. Bullet 20 is mounted in neck 16 of case 11.

The rifle is fired by pulling its trigger, which in turn causes the action to thrust the firing pin forward into decisive contact with percussion cap 13. When the firing pin strikes cap 13, primer in cap 13 will ignite powder 12 in case 11. Powder 12 combusts extremely rapidly, and the hot gases generated by that combustion propel bullet 20 out bore 2 of barrel 1 at high velocity. As shown in FIG. 1, barrel bore 2 is provided with grooves 3 that spiral helically along its length. As bullet 1 travels through bore 2, and as described in detail below, it will interact with helical grooves 3 and begin to spin along its axis.

As noted, rifles have a designated caliber and will use ammunition of the same designated caliber. Many aspects of the geometry and dimensions of the components in rifles and ammunition of a designated caliber are defined in the SAAMI specifications. The SAAMI specifications specify both nominal dimensions and an acceptable range of dimensions for each of the many designated calibers in which firearms are manufactured and sold commercially.

Though commonly referred to as being a "30" caliber rifle, the actual caliber of rifle of barrel 1 is 0.300 inches. Similarly, a "30" caliber cartridge is designed to be fired with a rifle with a barrel caliber of 0.300 inches. In the United States, that caliber designation means that the nominal bore diameter of barrel 1 is 0.300 inches. The actual n bore diameter of barrel 1, and the dimensions of other aspects of barrel 1, will vary from rifle to rifle. In almost all commercially manufactured firearms, however, the actual groove diameter and other dimensions will fall within the ranges specified in the SAAMI specifications.

For example, the SAAMI specifications for 30 caliber rifles specify that the nominal bore diameter is 0.300 inches, but allow actual bore diameters to range up to 0.002 inches greater than nominal (0.300+0.002 inches). The SAAMI specifications also specify that the nominal groove diameter of a 30-caliber rifle is 0.308 inches, but actual groove diameters also can be up to 0.002 inches greater than nominal (0.308+0.002 inches). Thus, commercially manufactured 30 caliber rifles may have a bore diameter of from 0.300 to 0.302 inches and a groove diameter of from 0.308 to 0.310.

The SAAMI specifications also provide nominal dimensions and acceptable ranges for many aspects of ammunition of a designated caliber. Cartridge 10 is a 30-caliber cartridge. The SAAMI specifications specify, for example, the overall length of cartridge 10, the length and major diameter of case 11, the length and angle of shoulder 15, and the length and diameter of neck 16. Neck 16, for example, has a nominal length of 0.2639 inches with an acceptable range of minus 0.020 inches and a nominal diameter of 0.3397 inches with an acceptable range of minus 0.008 inches.

Overview of Novel Bullets

Broad embodiments of the subject invention include bullets that comprise a shank with defined profiles and geometries. The novel bullets have a designated caliber adapted to be fired by a rifle having the same designated caliber. They are monolithic bullets. That is, excepting optional tips the novel bullets are a unitary piece of metal, such as copper or a copper alloy. Such metals are far less ductile than lead or jacketed bullets, and when fired, they interact with the bore of a rifle in significantly different ways. The defined profiles and geometries of the novel bullets, such as bullet 20, manage those dynamics to provide significantly improved performance over conventional monolithic bullets.

Figure 3A:
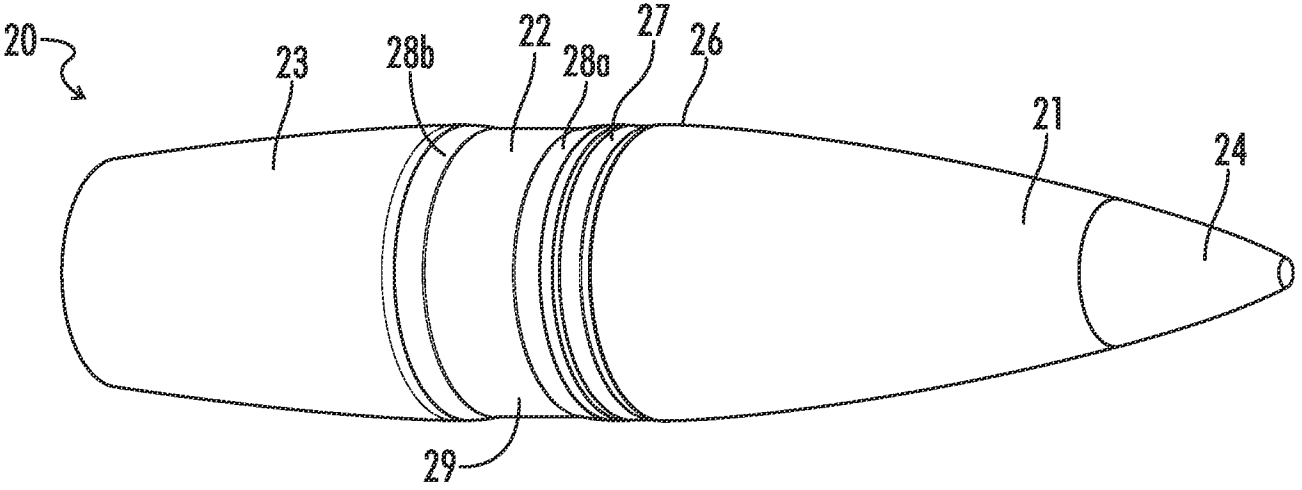
FIG. 3A is an isometric view of novel bullet 20 of cartridge 10.
Figure 3B:
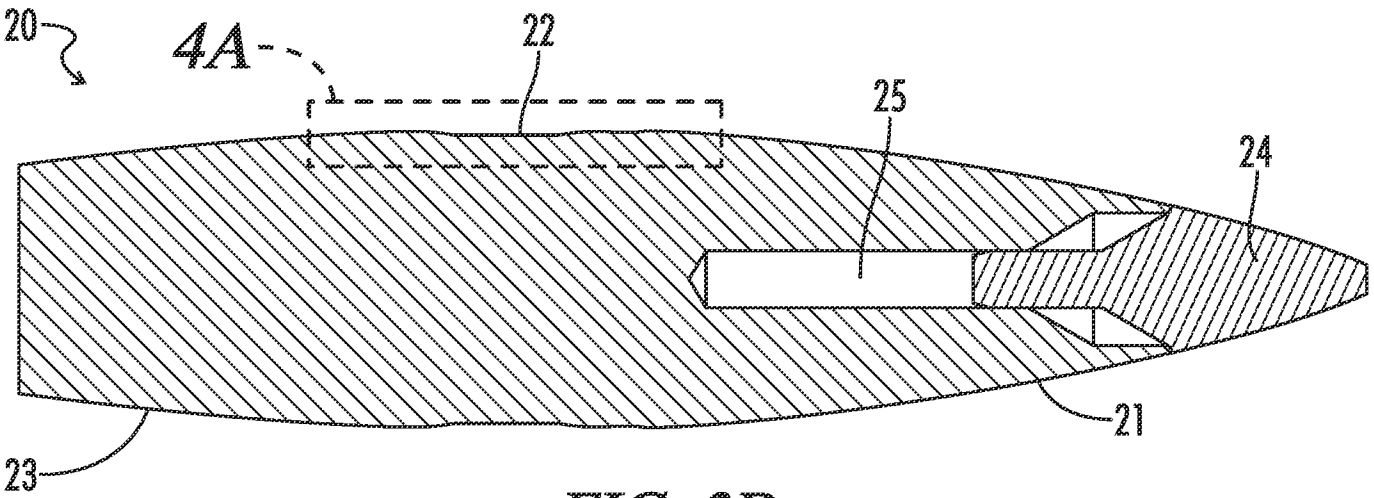
FIG. 3B is a cross-sectional view of bullet 20 shown in FIG. 3A.
Figure 4A:
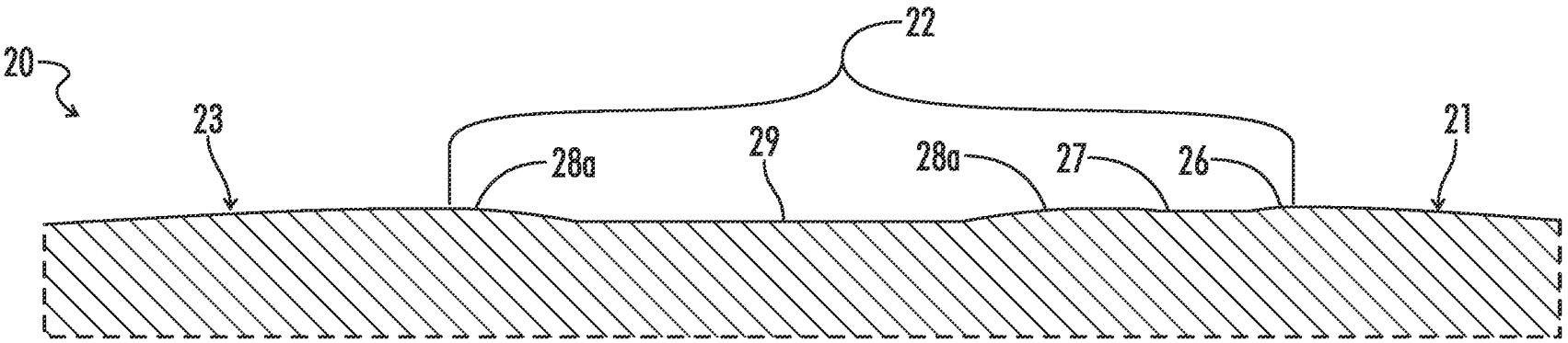
FIG. 4A is an enlarged, cross-sectional view taken from area 4 of FIG. 3B showing profiles in bullet 20.
Figure 4B:
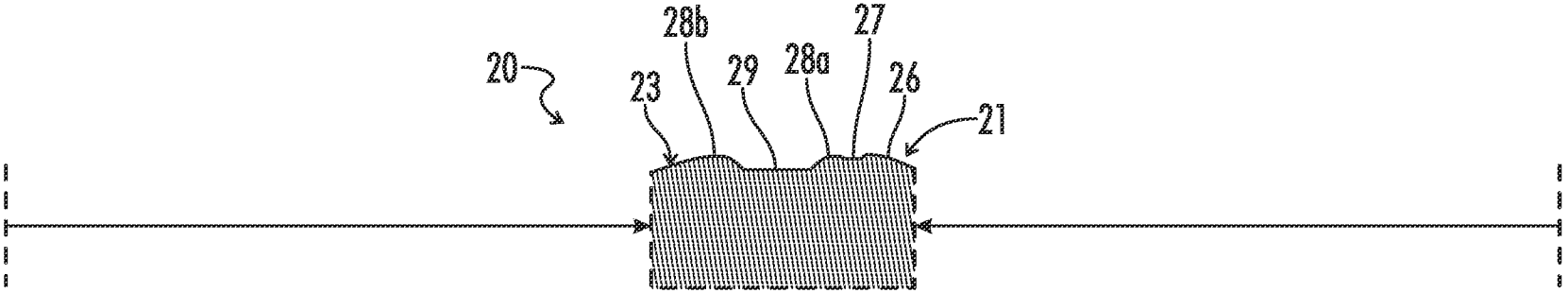
FIG. 4B is an enlarged, cross-sectional view of area 4 of FIG. 3D, which cross-sectional view has been compressed axially to exaggerate the profiles in bullet 20.

Monolithic bullet 20 is shown in greater detail in FIGS. 3-4. As may be seen therein, bullet 20 comprises a generally conical nose 21, a profiled, but generally cylindrical shank 22, and a tapered tail 23. Nose 21 is a "tipped," "hollow" nose having a tip 24. The predominantly conical end of nose 21 is truncated and provided with a cylindrical recess 25 extending axially into bullet 20. The forward portion of recess 25 tapers into a much narrower, longer rearward portion. Tip 24 has an axial peg that fits tightly within the reward portion of recess 25. Tip 24 allows nose 21 to have a hollow construction, yet maintain a tapered, aerodynamic profile.

Figure 2A:
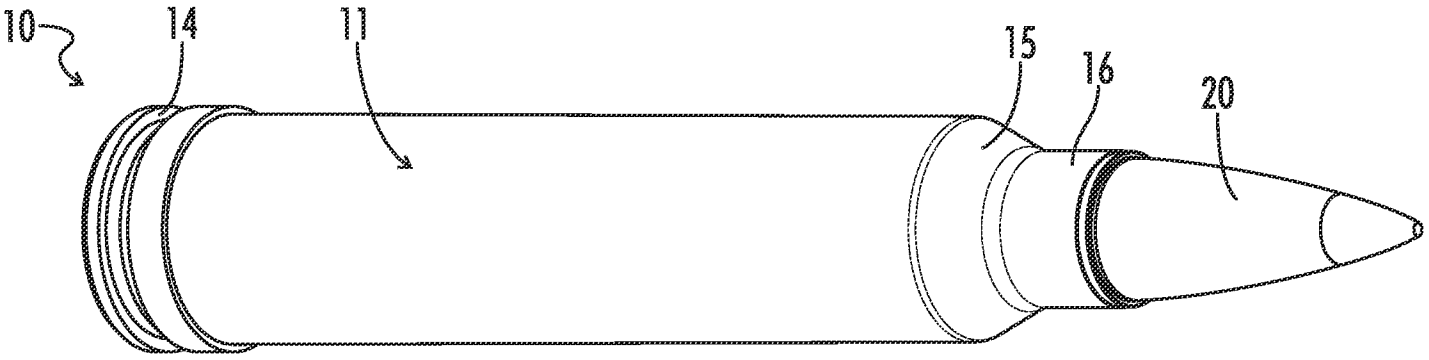
FIG. 2A is an isometric view of cartridge 10.
Figure 2B:
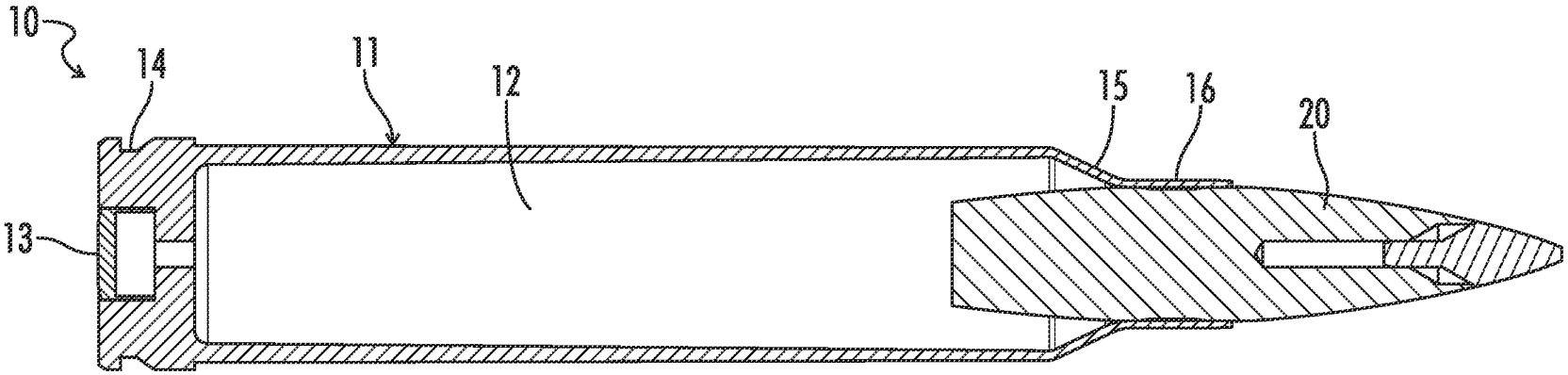
FIG. 2B is a cross-sectional view of cartridge 10.

Shank 22 is generally cylindrical, as may be appreciated from the scale of FIG. 2. It is the portion of bullet 20 having the largest diameter, and thus, shank 22 in large part controls the interaction between bullet 20 and bore 2 as it travels down barrel 1. Though generally cylindrical, shank 22 is profiled to provide bullet 20 with important advantages. The aspects of that profile are best appreciated from the enlarged scale of FIGS. 3-4. As may be seen therein, shank 22 has a sealing boss 26, a groove 27, case alignment bosses 28, and a bore riding surface 29.

Sealing boss 26 extends annularly around the circumference of shank 22 adjacent the rearward terminus of nose 21. It has a diameter somewhat greater than the nominal groove diameter for the designated caliber of bore 2. Preferably, it will have a diameter of from about 0.0001 to about 0.0015 inches greater than the nominal groove diameter of bore 2. Barrel 1, for example, has a designated caliber of 0.300 and the corresponding SAAMI specified nominal groove diameter is 0.308 inches. Sealing boss 26 of 30 caliber bullet 20 therefore will have a diameter of from about 0.3081 to about 0.3095 inches.

When fired, though far less than bullets made of more ductile lead, bullet 20 will slug slightly. The momentum of bullet 20 will cause grooves 3 to engrave and deform sealing boss 26, thus providing a seal between bullet 20 and bore 2. The seal will minimize the amount of gas that can blow by bullet 20, thus reducing the deleterious effects of blow-by and increasing the amount of momentum imparted to bullet 20.

Sealing boss 26 provides the only true seal between bullet 20 and bore 2. Thus, it must be strong enough to withstand the axial shear load created as it is propelled forward by hot, expanding gas ejected from cartridge 10. Otherwise, its axial length preferably is minimized so as to reduce friction between bullet 20 and bore 2 as it is travels out barrel 1. With that in mind, sealing boss 26 extends axially only a very short distance away from nose 21. Preferably it has an axial length of from about 0.001 to 0.008 inches. Sealing boss 26, therefore, can provide a reliable seal with barrel 2. At the same time, given the presence of groove 27 as discussed further below, sealing boss 26 will not create excessive friction between bullet 20 and barrel 2, even in relatively tight barrels.

The sealing boss of the novel bullets can provide greater consistency in the dynamics between the bullet and the bore and in turn greater consistency in the bullet's trajectory when fired from different rifles. That is, the SAAMI nominal maximum diameter of bullets of most calibers is slightly larger than the nominal groove diameter of the barrel. Allowing for the range of acceptable variation in those diameters, however, a bullet may be "tight" or "loose" depending on the exact bore dimensions of the rifle in which it is fired. For example, the SAAMI specifications for bullet 20 and other 30 caliber bullets specify a nominal maximum diameter of 0.309 inches with a range of minus 0.003 inches from nominal being permitted (0.309-0.0030 inches). The SAAMI specifications for 30 caliber bores, such as bore 2, specify a nominal bore diameter of 0.300 inches and a nominal groove diameter of 0.308 inches, both with a range of plus 0.002 inches from nominal being permitted.

The difference between specified diameters, therefore, means that the diameter of conventional 30 caliber bullets may be from 0.004 inches less than the groove diameter of the barrel, an extremely "loose" fit, to 0.001 inches greater, an extremely "tight" fit. At the lower end of that scale, the looseness of the fit means that there will be minimal sealing between the bullet and the bore. Relatively large amounts of gas can blow by the bullet, potentially damaging and fouling the barrel and diminishing the velocity and range of the bullet.

In contrast, the sealing boss of the novel bullets will ensure that there is a sufficiently, but not excessively tight fit with more barrels of differing actual groove diameters, including those with relatively large groove diameters. Sealing boss 26 of 30 caliber bullet 20, for example, will have a diameter of from about 0.3081 to about 0.3095 inches. That means that sealing boss 26 of 30 caliber bullet 2 will have a diameter of no more than 0.0015 inches greater than the minimum, tightest groove diameter of 30 caliber barrels, such as barrel 1, and no more than about 0.0019 inches less than the maximum, loosest groove diameter of 30 caliber barrels.

That range should provide adequate, but not excessively tight sealing in the majority of rifles. The problems attendant to "loose" barrels will be reduced and, importantly, without creating excessive friction between the bullet and barrel in "tight" barrels. Moreover, the novel bullets will have a more consistent trajectory when fired from rifles having different size barrels. Those benefits will be enhanced by the groove provided in the novel bullets, such as groove 27.

Groove 27 extends annularly around the circumference of shank 22 rearward of sealing boss 26. It provides an area of reduced diameter into which material from sealing boss 26 may move as it is deformed and engraved by bore grooves 3. Thus, the diameter of groove 27 is somewhat less than the nominal groove diameter for the designated caliber of bore 2, preferably from about 0.001 to about 0.004 inches less. For example, 30 caliber barrel 1 has a SAAMI nominal groove diameter of 0.308 inches, so the diameter of groove 27 is from about 0.304 to about 0.307 inches. The width, or axial length of groove 27 also is relatively small, preferably from about 0.025 to about 0.050 inches.

For loose bores, bullet 20 will not be heavily engraved and relatively little material from sealing boss 26 will be displaced. For tight bores, however, shank groove 27 greatly enhances the effects of sealing boss 26 in providing more consistent trajectories from rifle to rifle. Material is able to move from sealing boss 26 into groove 27, thus avoiding issues such as excessively high chamber pressures and excessive friction associated with overly tight seals. More importantly, because groove 27 provides a relief area for material from sealing boss 26, and because the axial length of sealing boss 26 itself is relatively short, the difference in energy required to engrave and deform sealing boss 26 from looser to tighter bores is minimized. Bullet 2 will have a much more consistent trajectory when fired from different rifles.

Shank 22 has two case alignment bosses 28*a* and 28*b*. The first case alignment boss 28*a* is rearward of groove 27 and forward of bore riding surface 29. The second case alignment boss 28*b* is rearward of bore riding surface 29. Case alignment bores 28 are sized to engage neck 16 and thus ensure proper alignment and stability of bullet 20 when it is mounted in case 11. They also help align bullet 20 along the bore axis as it enters bore 2. A greater spacing of case alignment bores 28 also helps to reduce resistance to forward travel of bullet 20 as it is engaged and engraved upon entering the throat of barrel 1. Thus, case alignment bores 28*a* and 28*b* should be spaced as far apart as practical, provided, however, that rear case alignment boss 28*b* is forward enough along shank 22 that it still engages neck 16. For example, cartridge 10 is a 30-caliber cartridge and, as derived from the SAAMI specifications, neck 16 has a length of 0.2619 to 0.2639 inches. Case alignment bores 28 will be spaced accordingly.

The width, or axial length of case alignment bosses 28*a* and 28*b* is somewhat larger that the width of sealing boss 26, but still relatively small. Preferably, it will be from about 0.010 to about 0.030 inches. The diameter of case alignment bosses 28*a* and 28*b* is about equal to or less than the nominal groove diameter for the designated caliber of bore 2. Preferably, the diameters of case alignment bosses 28*a* and 28*b* are from about equal to about 0.001 inches less than the nominal groove diameter of bore 2. For example, 30 caliber barrel 1 has a SAAMI nominal groove diameter of 0.308 inches, so the diameter of case alignment bosses 28 will be from about 0.308 to about 0.307 inches. Case alignment bosses 28 also help to increase the consistency of the trajectory of bullet 20 as it is fired in different rifles and help minimize galling in barrel 2. Their relatively short axial length and reduced diameter means that in many barrels they will not be heavily engraved, and will not create excessive resistance, especially as compared to sealing boss 26. More importantly, their reduced diameter relative to the nominal groove diameter of the designated caliber for bore 2 helps ensures that case alignment bosses 28 do not contact the bottom of grooves 3 in most rifles, even those with somewhat tight bores. As is the dynamics of sealing boss 26, the difference in energy required to engrave and deform case alignment bores 28 from looser to tighter bores is minimized. Bullet 2 will have a much more consistent trajectory when fired from different rifles.

Bore riding surface 29 has a diameter approximately equal to the nominal bore diameter for the designated caliber of barrel 1, preferably plus-minus approximately 0.0005 inches. For example, 30 caliber barrel 1 has a SAAMI nominal bore diameter of 0.300 inches, so the diameter of bore riding surface 29 will be from about 0.2995 to about 0.3005 inches. Unlike other aspects of the profile of shank 22, however, bore riding surface 29 will extends axially across a substantial portion of shank 22. Bore riding surface 29 will in most rifles only lightly engage the lands of grooves 3 and will only be lightly engraved. The light contact helps to align and stabilize bullet 2, especially as it enters the throat of bore 2, but minimizes frictional contact as bullet 20 travels through bore 2.

The profiles in shank 22 may be provided by right-angle grooves. As best appreciated from FIG. 4, however, shank groove 27 and bore riding surface 29 preferably are provided with tapered transition areas out of and into their adjacent profile elements. For example, shank groove 27 has a transition area leading out of sealing boss 26 and a transition area leading into the forward case alignment boss 28*a*. Bore riding surface 29 has a transition area leading out of forward case alignment boss 28*a* and a transition area leading into rear case alignment boss 28*b*. Any bore riding surface to the rear of case alignment boss 28*b* preferably would have a transition area leading out of bore alignment boss 28*b*.

Preferably, those tapered transition areas extend at a nominal angle of from about 1° to about 15°. The transition may be a bevel. Alternately, it may be a curve, such as a radius, or an ogive, such as a parabolic ogive or a von Karman or other Haack ogive. Preferably, if the transition area is an ogive, its curve will intersect with the adjacent raised profile at a secant, and not tangentially. A tangential intersection will tend to create more area that is susceptible to engraving as the bullet travels out the bore, especially if the transition area leads out of sealing boss 26. The transitions areas of groove 27 and bore riding surface 29, for example, are radii that intersect at a secant to their adjacent profile elements.

As noted, nose 21 is tapered and leads into sealing boss 26. The taper preferably is an ogive, such as a parabolic such as a parabolic ogive or a von Karman or other Haack ogive. The ogive of nose 21, for example, is a von Karman ogive and intersects with sealing boss 26 at a secant. As with the transition areas, the ogive of nose 21 preferably will not intersect with sealing boss 26 at a tangent. When nose 21 leads into sealing boss 26 at a tangent, the rear portions of nose 21 are more prone to engraving, thus creating more friction between bullet 20 and bore 2 as it travels through barrel 1. In general, however, many conventional nose geometries may be used in the nose of the novel bullets.

Similarly, the nose of the novel bullets may have different and generally conventional designs. Nose 21 of bullet 20, for example is a hollow, tipped nose. A second preferred embodiment 120 and a third preferred embodiment 220 of the novel bullets have, respectively, a hollow nose and a solid nose.

Figure 5A:
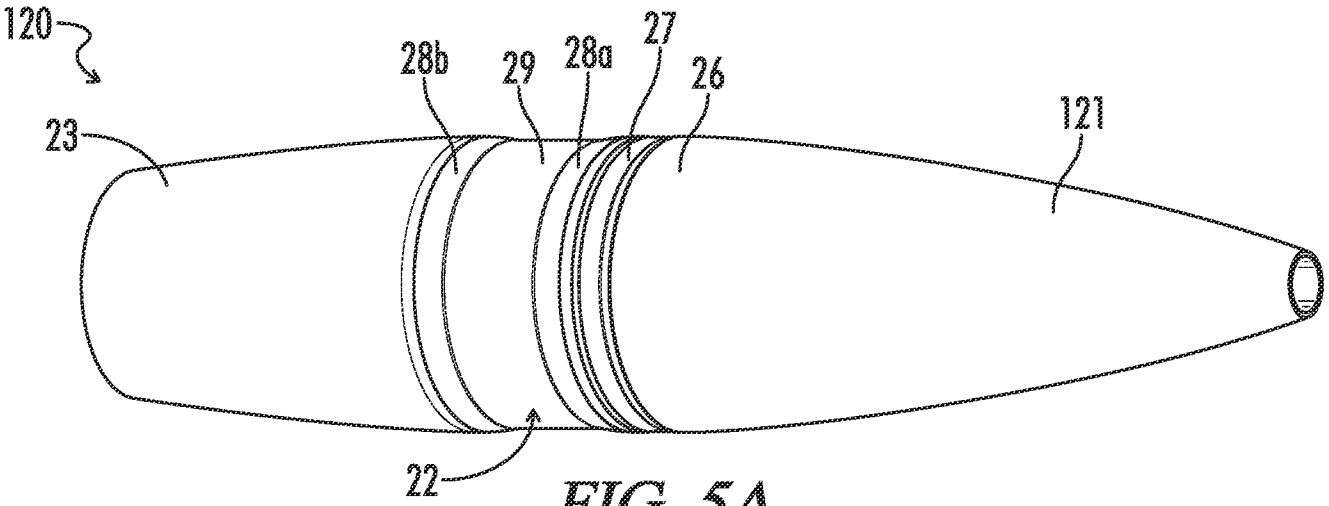
FIG. 5A is an isometric view of a second preferred embodiment 120 of the bullets of the subject invention.
Figure 5B:
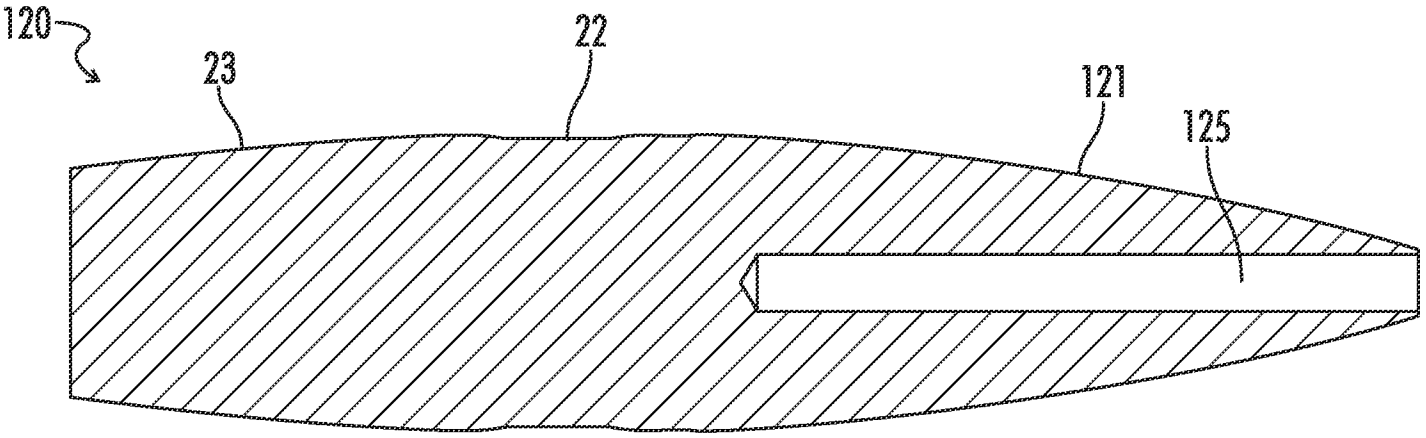
FIG. 5B is a cross-sectional view of novel bullet 120 shown in FIG. 5A.

Novel bullet 120 is shown in greater detail in FIG. 5. A shown therein, excepting its nose 121, novel bullet 120 is identical to novel bullet 20. Like nose 21 of bullet 20, nose 121 of bullet 120 is a "hollow" nose: a cylindrical recess 125 extends axially into bullet 120 from the forward end of nose 121. The ogive of nose 121 also intersects with sealing boss 26 at a secant. Nose 121, however, lacks a tip such as tip 24 of bullet 20.

Figure 6A:
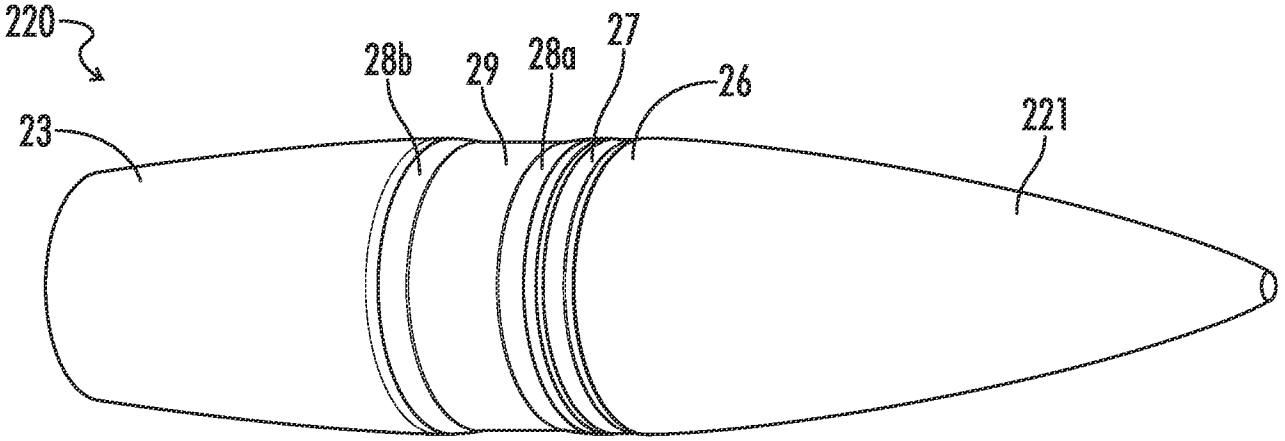
FIG. 6A is an isometric view of a third preferred embodiment 220 of the bullets of the subject invention.
Figure 6B:
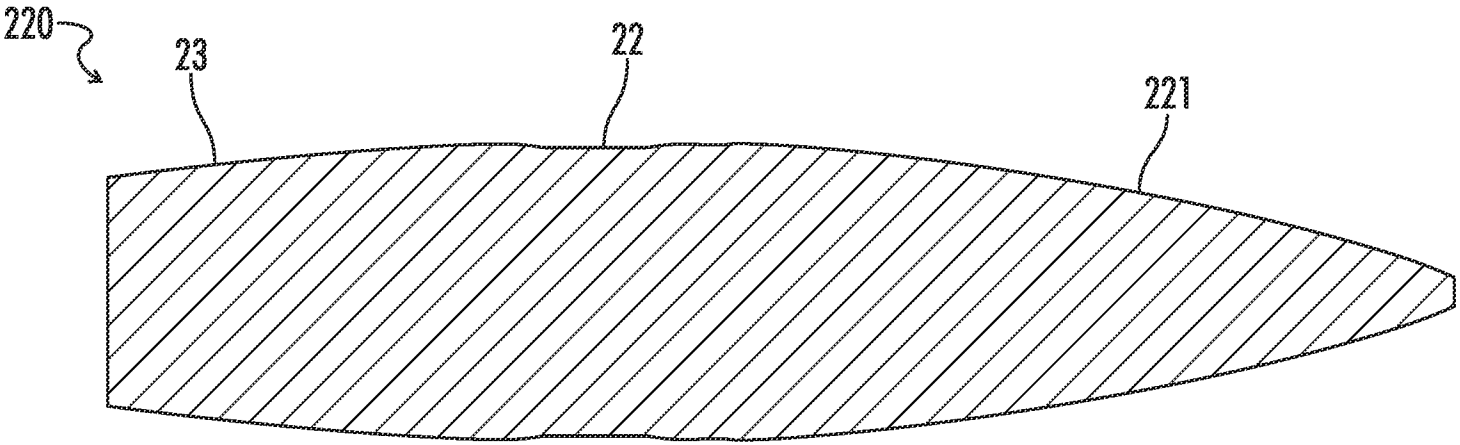
FIG. 6B is a cross-sectional view of novel bullet 220 shown in FIG. 6A.

Novel bullet 220 is shown in greater detail in FIG. 6. It also is identical to bullets 20 and 120 except for its nose 221. Nose 221 of bullet 220 is solid with only a small truncation at its forward end. Like noses 121 and 221, the ogive of nose 221 of bullet 220 intersects with sealing boss 26 at a secant.

The novel bullets preferably are provided with a tapered tail portion, often referred to as a boat tail. Bullet 20, for example, has a tapered tail 23. The tapering away of tail 23 minimizes contact between it and bore 3, and thus reduces friction between bullet 2 and bore 2 as it is fired through barrel 1. Tapered tail 23 also reduces drag on bullet 20 as it travels through the air.

The specific geometry of tail 23 may be varied and can have any of the conventional designs knows to improve the aerodynamic profile of bullets in flight. Such geometries are similar to those employed in the nose. Tail 23, for example, is a truncated ogive having a von Karman curve. Preferably, as in nose 21, the curve of the ogive leads out of shank 22 at a secant, and not tangentially. As noted, tangential transitions increase the areas of bullet 20 that are susceptible to engraving.

Though a tapered tail portion is generally preferred, a tail having a uniform diameter may be provided if desired. Conceptually, that also may be viewed as simply an extension of the shank portion. Regardless of how it is viewed, such an extension may provide increased stability as the bullet travels through the bore. The portion of the bullet rearward of the rearward case alignment boss in that event preferably will have a diameter approximately equal to the nominal bore diameter so as to provide additional bore riding surface.

Making and Using the Novel Bullets and Cartridges

It will be appreciated that the novel bullets have been exemplified in the context of 30 caliber bullets and bores and the corresponding SAAMI specifications. Other embodiments, however, may have any of the designated calibers in common use. For smaller calibers, it generally is preferable that the specified shank profile elements have diameters toward the smaller end of the described preferred ranges. For larger calibers it is generally preferable to use diameters toward the larger end of the described preferred ranges. In any event, workers in the art having the benefit of this disclosure and by referring to the SAAMI specifications will be able to design bullets in accordance with the invention in whatever caliber may be desired. With that in mind, the disclosure of the SAAMI American National Standard: Voluntary Industry Performance Standards for Pressure and Velocity of Centerfire Rifle Ammunition for the Use of Commercial Manufacturers (SAAMI Z299.4-2015), including the Cartridge and Chamber Drawings included therein, are hereby incorporated in their entirety by this reference hereto, and a copy of the publication is being filed concurrently herewith.

The novel bullets and cartridges may be fabricated from materials and by methods and equipment generally used in the manufacture of rifle ammunition. Since they are monolithic bullets, excepting optional tips, such as tip 24 of bullet 20, they are composed of a unitary piece of metal. Suitable metals include copper and copper alloys, such as gilding metal. Gilding metal is a copper-zinc alloy with relatively large amounts of copper and small amounts of zinc, typically from about 5 to about 11% zinc. The novel bullets may be manufactured by casting, but preferably will be made by extruding a cylindrical metal blank that then is machined to provide the desired profiles. Tips, if present, typically will be made from a relatively hard, molded polymer, such as polyoxymethylene and polyester urethane-methylenebis (phenylisocyanate) copolymers, or less commonly from metals such as brass, bronze, and aluminum.

The cartridge case may be fabricated from steel, but more commonly is made of a brass, such as cartridge brass (C260), low brass (C240), and Muntz metal (C280). Such brass alloys typically have from about 70 to 80% copper, about 30 to about 20% zinc, and trace amounts of iron, silicon, and chromium. They are manufactured by press molding and drawing metal sheets into a tube. The tube is then trimmed, stamped, machined, pressed molded, and punched to provide the cartridges primer pocket, neck, and flash hole. Suitable cases are available commercially from a number of manufacturers, for example, from Peterson Cartridge, Cranberry Township, Pennsylvania.

The novel cartridges are packed with conventional powder, most commonly n nitrocellulose or a mixture of nitrocellulose and nitroglycerin. Suitable powders are available commercially, for example, from Hodgdon Powder Co. Likewise, the novel cartridges will use conventional percussion caps having conventional primers. They too are available commercially, for example, from Winchester Repeating Arms, Morgan, Utah.

Assembly of the novel cartridges also may be accomplished with conventional equipment used in commercial manufacturing and personal reloading. In that regard it will be noted that a tapered tail, such as boat tail 23, provides a natural lead into the neck of a cartridge. Since the case alignment bores also serve to help align and stabilize the novel bullets as they are mounted in the cartridge case, the case and reloading dies will be selected and sized accordingly. Shank groove 27 also will provide an annular recess into which the end of case neck 16 may be crimped to mount bullet 20 in case 11. Its size and shape also are coordinated to match standard collet crimp dies used to mount bullet 2 in neck 16 of case 11. Dies and other equipment for personal reloading are available from various manufactures, including Lee Precision, Hartford, Wis.

As should be apparent from the specification and drawings, "axial," "radial," and forms thereof reference the central axis of a rifle barrel, a cartridge, and a bullet, all of which are aligned when the cartridge is loaded. For example, axial movement or position refers to movement or position generally along or parallel to the central axis. "Radial" will refer to positions or movement toward or away from the central axis.

Moreover, though described to a certain extent, it will be appreciated that the components of the novel cartridge have additional features that are not shown in the figures or discussed in detail herein. Such additional features, and their design and use in rifle cartridges is well known and well within the skill of workers in the art. In many respects, therefore, discussion of such features is omitted from the description of preferred embodiments.

While this invention has been disclosed and discussed primarily in terms of specific embodiments thereof, it is not intended to be limited thereto. Other modifications and embodiments will be apparent to the worker in the art.

What is claimed is:

1. A firearm, said firearm comprising:

(a) a chamber and a rifled barrel, said rifled barrel having:
  i) a designated caliber; and
  ii) a nominal bore diameter and a nominal groove diameter associated with said barrel caliber; and (b) a cartridge loaded in said chamber, said cartridge comprising a monolithic bullet having a designated caliber the same as said barrel caliber;

(c) said bullet comprising:
  i) a tapered nose;
  ii) a generally cylindrical shank; said bullet shank comprising:
    (1) a sealing boss adjacent said tapered nose, said sealing boss having a diameter greater than the nominal groove diameter of said rifled barrel;
    (2) a groove adjacent said sealing boss, said groove having a diameter less than the nominal groove diameter of said rifled barrel;
    (3) a first case alignment boss adjacent said groove, said case alignment boss having a diameter approximately equal to or less than the nominal groove diameter of said rifled barrel; and
    (4) a bore riding surface adjacent said first case alignment boss, said bore riding surface having a diameter approximately equal to the nominal bore diameter of said rifled barrel;
  iii) wherein said bullet shank is formed from one piece of solid metal.

2. The firearm of claim 1, wherein said bullet sealing boss has a diameter from about 0.0001 to about 0.0015 inches larger than the nominal groove diameter of said rifled barrel.

3. The firearm of claim 2, wherein said bullet sealing boss has an axial length of from about 0.001" to 0.008 inches.

4. The firearm of claim 2, wherein said bullet groove has a diameter from about 0.001 to about 0.004 inches smaller than the nominal groove diameter of said rifled barrel.

5. The firearm of claim 1, wherein said bullet sealing boss has an axial length of from about 0.001" to 0.008 inches.

6. The firearm of claim 1, wherein said bullet groove has a diameter from about 0.001 to about 0.004 inches smaller than the nominal groove diameter of said rifled barrel.

7. The firearm of claim 6, wherein said bullet groove has an axial length of from about 0.025 to about 0.050 inches.

8. The firearm of claim 1, wherein said bullet groove has an axial length of from about 0.025 to about 0.050 inches.

9. The firearm of claim 1, wherein:

(a) wherein said bullet sealing boss has a diameter from about 0.0001 to about 0.0015 inches larger than the nominal groove diameter of said rifled barrel and an axial length of from about 0.001" to 0.008 inches; and (b) said bullet groove has a diameter from about 0.001 to about 0.004 inches smaller than the nominal groove diameter of said rifled barrel and an axial length of from about 0.025 to about 0.050 inches.

10. The firearm of claim 1, wherein said bullet case alignment boss has a diameter from about equal to about 0.001 inches less than the nominal groove diameter of said rifled barrel.

11. The firearm of claim 10, wherein said bullet case alignment boss has an axial length of from about 0.01 to about 0.03 inches.

12. The firearm of claim 10, wherein:

(a) said first case alignment boss is adjacent the forward limit of said bore riding surface; and (b) said bullet shank comprises a second case alignment boss adjacent the rearward limit of said bore riding surface, said second case alignment boss having a diameter approximately equal to or less than the nominal groove diameter of said rifled barrel.

13. The firearm of claim 1, wherein:

(a) said first case alignment boss is adjacent the forward limit of said bore riding surface; and (b) said bullet shank comprises a second case alignment boss adjacent the rearward limit of said bore riding surface, said second case alignment boss having a diameter approximately equal to or less than the nominal groove diameter of said rifled barrel.

14. The firearm of claim 1, wherein said bullet bore riding surface has a diameter equal to the nominal bore diameter of said rifled barrel plus-minus 0.0005 inches.

15. The firearm of claim 1, wherein:

(a) wherein said bullet sealing boss has a diameter from about 0.0001 to about 0.0015 inches larger than the nominal groove diameter of said rifled barrel and an axial length of from about 0.001" to 0.008 inches;

(b) said bullet groove has a diameter from about 0.001 to about 0.004 inches smaller than the nominal groove diameter of said rifled barrel and an axial length of from about 0.025 to about 0.050 inches;

(c) said first case alignment boss is adjacent the forward limit of said bore riding surface;

(d) said bullet shank comprises a second said case alignment boss adjacent the rearward limit of said bore riding surface;

(e) wherein said first and second case alignment bosses have diameters from about equal to about 0.001 inches less than the nominal groove diameter of said rifled barrel and axial lengths of from about 0.01 to about 0.03 inches; and (f) said bullet bore riding surface has a diameter equal to the nominal bore diameter of said rifled barrel plus-minus 0.0005 inches.

16. The firearm of claim 1, wherein the taper of said bullet nose is an ogive having a parabolic, Haack, or von Karman curve.

17. The firearm of claim 16, wherein said ogive intersects with said bullet sealing boss at a secant.

18. The firearm of claim 1, wherein said bullet nose is a hollow nose having a tip.

19. The firearm of claim 1, wherein said bullet nose is a hollow nose.

20. The firearm of claim 1, wherein said bullet nose is a solid nose.

21. The firearm of claim 1, wherein said bullet comprises a tail portion.

22. The firearm of claim 21, wherein said bullet tail portion is tapered.

23. The firearm of claim 22, wherein the taper of said tail is an ogive having a parabolic curve or a von Karman or other Haack curve.

24. The firearm of claim 23, wherein said ogive intersects with a second case alignment boss adjacent the rearward limit of said bore riding surface.

25. The firearm of claim 1, wherein said bullet comprises a tapered transition area between one or more of said sealing boss and said groove, said groove and said case alignment boss, and said case alignment boss and said bore riding surface.

26. The firearm of claim 25, wherein said tapered transition area extends at an angle of from about 1° to about 15°.

27. The firearm of claim 25, wherein the taper of said transition area is an ogive having a parabolic curve or a von Karman or other Haack curve.

28. The firearm of claim 27, wherein said ogive intersects with a raised profile element of said shank at a secant.

29. The firearm of claim 1, said cartridge comprising:

(a) a case;

(b) powder; and (c) said bullet.

30. The firearm of claim 29, wherein:

(a) said bullet is mounted in a neck of said cartridge; and (b) the periphery of said neck is crimped into said groove.

31. The firearm of claim 29, wherein said cartridge comprises a percussion cap in which is carried a primer.

32. A monolithic bullet, said bullet comprising:

(a) a tapered nose; and (b) a generally cylindrical shank rearward of said nose, said shank being formed from one piece of metal and comprising:

i) a sealing boss adjacent said nose and having a sealing boss diameter;

ii) a groove adjacent said sealing boss and having a groove diameter;

iii) a first case alignment boss adjacent said groove and having a case alignment boss diameter; and iv) a bore riding surface adjacent said case alignment boss and having a bore riding surface diameter; and (c) wherein:

i) said sealing boss diameter is a maximum diameter of said bullet shank;

ii) said bore riding surface diameter is a minimum diameter of said bullet shank;

iii) said case alignment boss diameter is larger than said groove diameter; and iv) said case alignment boss diameter and said groove diameter are between said sealing boss diameter and said bore riding surface diameter.

33. The bullet of claim 32, wherein said sealing boss has an axial length of from about 0.001" to 0.008 inches.

34. The bullet of claim 32, wherein said groove has an axial length of from about 0.025 to about 0.050 inches.

35. The bullet of claim 32, wherein said case alignment boss has an axial length of from about 0.01 to about 0.03 inches.

36. The bullet of claim 32, wherein:

(a) said first case alignment boss is adjacent the forward limit of said bore riding surface; and (b) a second case alignment boss is adjacent the rearward limit of said bore riding surface.

37. The bullet of claim 32, wherein the taper of said nose is an ogive having a parabolic, Haack, or von Karman curve.

38. The bullet of claim 37, wherein said ogive intersects with said sealing boss at a secant.

39. The bullet of claim 32, wherein said nose is a hollow nose having a tip.

40. The bullet of claim 32, wherein said nose is a hollow nose.

41. The bullet of claim 32, wherein said nose is a solid nose.

42. The bullet of claim 32, wherein said bullet comprises a tail portion and said shank is between the nose and the tail.

43. The bullet of claim 42, wherein said tail portion is tapered.

44. The bullet of claim 43, wherein the taper of said tail is an ogive having a parabolic curve or a von Karman or other Haack curve.

45. The bullet of claim 44, wherein said ogive intersects with a second said case alignment boss adjacent the rearward limit of said bore riding surface.

46. The bullet of claim 32, wherein said bullet comprises a tapered transition area between one or more of said sealing boss and said groove, said groove and said case alignment boss, and said case alignment boss and said bore riding surface.

47. The bullet of claim 46, wherein said tapered transition area extends at an angle of from about 1° to about 15°.

48. The bullet of claim 46, wherein the taper of said transition area is an ogive having a parabolic curve or a von Karman or other Haack curve.

49. The bullet of claim 48, wherein said ogive intersects with a raised profile element of said shank at a secant.

50. A cartridge for a firearm with a rifled barrel, said cartridge comprising:

(a) a case;

(b) powder; and (c) the bullet of claim 32.

51. The cartridge of claim 50, wherein:

(a) said bullet is mounted in a neck of said cartridge; and (b) the periphery of said neck is crimped into said groove.

52. The cartridge of claim 50, wherein said cartridge comprises a percussion cap in which is carried a primer.

* * * * *